US007552801B2

(12) United States Patent
Trifu

(10) Patent No.: US 7,552,801 B2
(45) Date of Patent: Jun. 30, 2009

(54) ELEVATOR SYSTEMS HAVING DISPLAY SYSTEMS WITH PLURALITIES OF SEQUENTIALLY CONNECTED MONITOR UNITS

(75) Inventor: Victor Trifu, Cropseyville, NY (US)

(73) Assignee: Electronics Micro Systems, Inc., Hauppauge, NY (US)

( * ) Notice: Subject to any disclaimer, the term of this patent is extended or adjusted under 35 U.S.C. 154(b) by 583 days.

(21) Appl. No.: 11/235,883

(22) Filed: Sep. 27, 2005

(65) Prior Publication Data

US 2006/0065492 A1 Mar. 30, 2006

Related U.S. Application Data

(60) Provisional application No. 60/613,534, filed on Sep. 27, 2004.

(51) Int. Cl.
*B66B 1/34* (2006.01)

(52) U.S. Cl. ..... 187/391; 187/396

(58) Field of Classification Search ..... 187/247, 187/391–396
See application file for complete search history.

(56) References Cited

U.S. PATENT DOCUMENTS

| | | | | |
|---|---|---|---|---|
| 4,577,177 | A | 3/1986 | Marubashi | |
| 4,749,062 | A | 6/1988 | Tsuji et al. | |
| 4,852,696 | A * | 8/1989 | Fukuda et al. | 187/392 |
| 4,853,678 | A | 8/1989 | Bishop, Jr. et al. | |
| 4,860,207 | A * | 8/1989 | Kubo | 187/247 |
| 4,979,593 | A * | 12/1990 | Watanabe et al. | 187/245 |
| 4,995,479 | A | 2/1991 | Fujiwara et al. | |
| 5,056,629 | A | 10/1991 | Tsuji et al. | |
| 5,360,952 | A | 11/1994 | Brajczewski et al. | |
| 5,387,769 | A | 2/1995 | Kupersmith et al. | |
| 5,392,066 | A | 2/1995 | Fisher et al. | |
| 5,606,154 | A | 2/1997 | Doigan et al. | |
| 5,642,484 | A | 6/1997 | Harrison, III et al. | |
| 5,844,181 | A | 12/1998 | Amo et al. | |
| 5,955,710 | A | 9/1999 | DiFranza | |
| 6,073,727 | A | 6/2000 | DiFranza et al. | |
| 6,082,500 | A | 7/2000 | Amo et al. | |
| 6,288,688 | B1 | 9/2001 | Hughes et al. | |
| 6,578,675 | B2 | 6/2003 | Wilson et al. | |

(Continued)

FOREIGN PATENT DOCUMENTS

| | | |
|---|---|---|
| CA | 2234363 | 4/1997 |

(Continued)

*Primary Examiner*—Jonathan Salata
(74) *Attorney, Agent, or Firm*—Dinsmore & Shohl, LLP

(57) ABSTRACT

A display system includes multiple monitor units which each include an enclosure, a display screen, a communication port, a storage device, and a control circuit. A communications conduit sequentially connects the monitor units and is selectively connectable with a general purpose computer. Each monitor unit is individually addressable over the communications conduit by a general purpose computer for receiving individualized control information and image information therefrom. The control circuit of each of the monitor units is configured to store the control information and the image information within the storage device, and is further configured to act in accordance with the stored control information to selectively provide at least some of the stored image information to the display screen. The control circuit does not include a general purpose computer and is unable to operate an off-the-shelf operating system. An elevator system is also provided, as are methods of displaying information.

14 Claims, 4 Drawing Sheets

U.S. PATENT DOCUMENTS

| | | | | |
|---|---|---|---|---|
| 6,981,576 | B2 * | 1/2006 | Amo et al. | 187/396 |
| 2002/0066621 | A1 | 6/2002 | Wilson et al. | |
| 2003/0158901 | A1 | 8/2003 | Ludwig et al. | |
| 2004/0022377 | A1 | 2/2004 | Elberbaum | |
| 2004/0055830 | A1 | 3/2004 | Amo et al. | |
| 2004/0068583 | A1 | 4/2004 | Monroe et al. | |
| 2004/0076398 | A1 | 4/2004 | Chai | |
| 2004/0134718 | A1 | 7/2004 | Matsuda et al. | |

FOREIGN PATENT DOCUMENTS

| | | | |
|---|---|---|---|
| EP | 1267230 | A2 | 12/2002 |
| EP | 0744100 | B1 | 9/2003 |
| EP | 1397005 | A2 | 3/2004 |
| EP | 1431869 | A2 | 6/2004 |
| JP | 60016781 | | 1/1985 |
| JP | 61136887 | | 6/1986 |
| JP | 62196283 | | 8/1987 |
| JP | 2004043116 | | 2/2004 |
| JP | 2004088411 | | 3/2004 |
| JP | 2004107036 | | 4/2004 |
| JP | 2004120593 | | 4/2004 |
| WO | WO 2004031063 | | 4/2004 |

* cited by examiner

ELEVATOR SYSTEMS HAVING DISPLAY SYSTEMS WITH PLURALITIES OF SEQUENTIALLY CONNECTED MONITOR UNITS

RELATED APPLICATION

The present application claims priority of U.S. Provisional Application Ser. No. 60/613,534 filed Sep. 27, 2004, and hereby incorporates herein by reference the same Provisional Application (including, but not limited to, "Appendix A" entitled "Lobby Intercom Display, Version 3").

TECHNICAL FIELD

The present invention relates to display systems and methods having individually addressable monitor units. By way of example, these display systems and methods can be used to display advertisements and the like, and can include monitor units that are located, for example, within elevator cabs and/or within elevator lobbies.

BACKGROUND OF THE INVENTION

Time spent by elevator passengers riding in an elevator cab and/or waiting within an elevator lobby for an elevator cab to arrive is typically wasted. During such circumstances, it is typical for such persons to feel awkward, and they accordingly may strive to avoid making eye contact with other passengers. Accordingly, there is a need for an improvement in elevator cabs and elevator lobbies that facilitates effective time usage by those persons riding in an elevator cab or waiting within an elevator lobby.

SUMMARY OF THE INVENTION

Accordingly, it is one aspect of the present invention to provide an improvement in elevator cabs and elevator lobbies that facilitates effective time usage by those persons riding in an elevator cab or waiting within an elevator lobby. To achieve the foregoing and other aspects, and in accordance with the purposes of the present invention defined herein, display systems and methods having individually addressable monitor units are disclosed.

For example, in one embodiment, a display system includes a plurality of monitor units, each of which has an enclosure that supports a display screen, a communication port, a power port, a storage device, and a control circuit. The control circuit is electrically connected with each of the display screen, the communication port, the power port, and the storage device. While the control circuit does not comprise a general purpose computer and is unable to operate an off-the-shelf operating system, it is selectively connected to a general purpose computer via a communications conduit. More particularly, the communications conduit is sequentially connected to the communication port of each monitor unit such that each monitor unit is individually addressable over the communications conduit to receive individualized control information and image information from the general purpose computer when connected thereto by the communications conduit. The control circuit of each monitor unit stores the control information and the image information within the storage device and acts in accordance with the stored control information to selectively provide the stored image information to the display screen.

In another embodiment, an elevator system is provided for movement of passengers among respective floors of a building. The elevator system has an elevator cab that is moveably supported within an elongated vertical passageway adjacent to a plurality of lobbies respective to each floor of the building. A control system is connected with the elevator cab and selectively moves the elevator cab through the passageway so that the elevator cab may drop off and receive passengers to and from the lobbies. A display system may be provided to the elevator system with monitor units of the display system disposed in locations visible to elevator passengers, such as inside of the elevator cab and in the lobbies. The monitor units may be sequentially connected among the floors of the building and into the elevator cab(s).

Further additional exemplary embodiments are contemplated that related to methods of displaying image information on a plurality of monitors units connected over a sequential arrangement. Image information and control information are provided to the monitor units by a general purpose computer via a communications conduit. The image information and control information are stored in the monitor units such that the image information is displayed by the monitor units in accordance with control information.

Accordingly, the present invention is advantageous for providing an improvement in elevator cabs and elevator lobbies that facilitates effective time usage by those persons riding in an elevator cab or waiting within an elevator lobby. Additional aspects, advantages, and novel features of the invention will be set forth in part in the description that follows, and in part will become apparent to those skilled in the art upon examination of the following, or may be learned with the practice of the invention. The aspects and advantages of the invention may be realized or attained by means of the instrumentalities and combinations as set forth herein and as will be apparent to those of ordinary skill in the art.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION OF EMBODIMENTS

Figure 1:
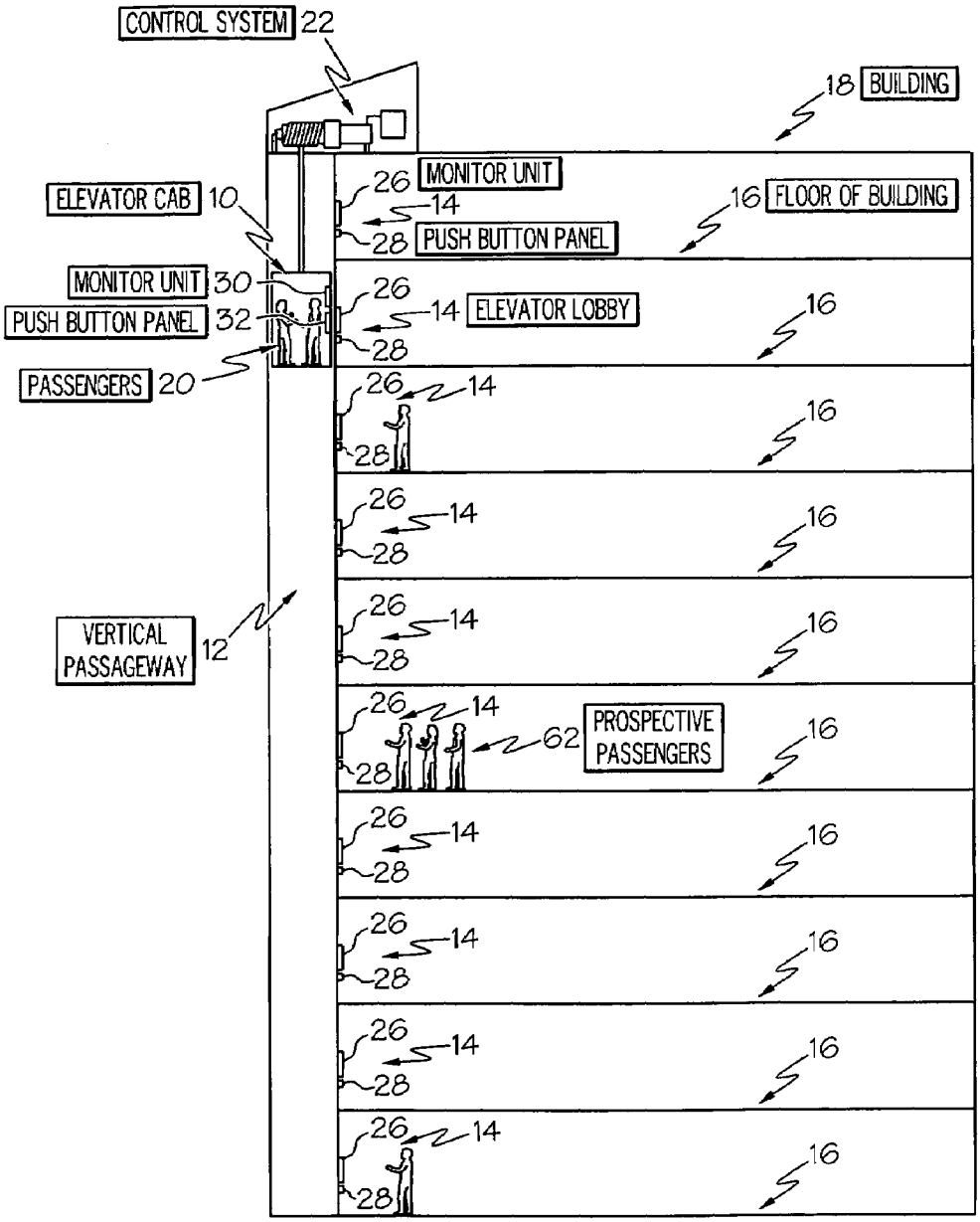
FIG. 1 is a schematic view depicting a building having an elevator system having a display system in accordance with one embodiment of the present invention.

The present invention and its operation is hereinafter described in detail in connection with the views and examples of FIGS. 1-4 wherein like numbers indicate the same or corresponding elements throughout the views. FIG. 1 depicts a building 18 having a vertical passageway 12 and an elevator system 11. The elevator system 11 is shown to include one elevator cab 10, although it will be understood that an elevator system in accordance with the teachings of the present invention may include any number of elevator cabs.

In the embodiment of FIG. 1, elevator cab 10 is supported by cables from an overhead control system 22. The control system 22 can include any and all components that are required and/or used to facilitate controlled vertical movement of the elevator cab 10 within the vertical passageway 12. The elevator cab 10 can accordingly be moved by the control system 22 between any of a variety of floors 16 of the building 18. An elevator lobby 14 can be provided on each floor 16 near the location at which the elevator cab 10 can be accessed for ingress or egress by passengers (e.g., 20). As used herein, the term "elevator lobby" merely refers to the area adjacent the elevator doors on each floor (i.e., the area where prospective elevator passengers wait for an elevator). The elevator lobby need not be physically separate or isolated from other parts of the building.

Elevator cab 10 is shown to have a pushbutton panel 32 that is configured to receive floor selections and other input from passengers 20. Likewise, pushbutton panels 28 can be provided within each elevator lobby 14 and can be configured to enable prospective elevator passengers (e.g., 62) to call the elevator cab 10 to their floor location.

Figure 2:
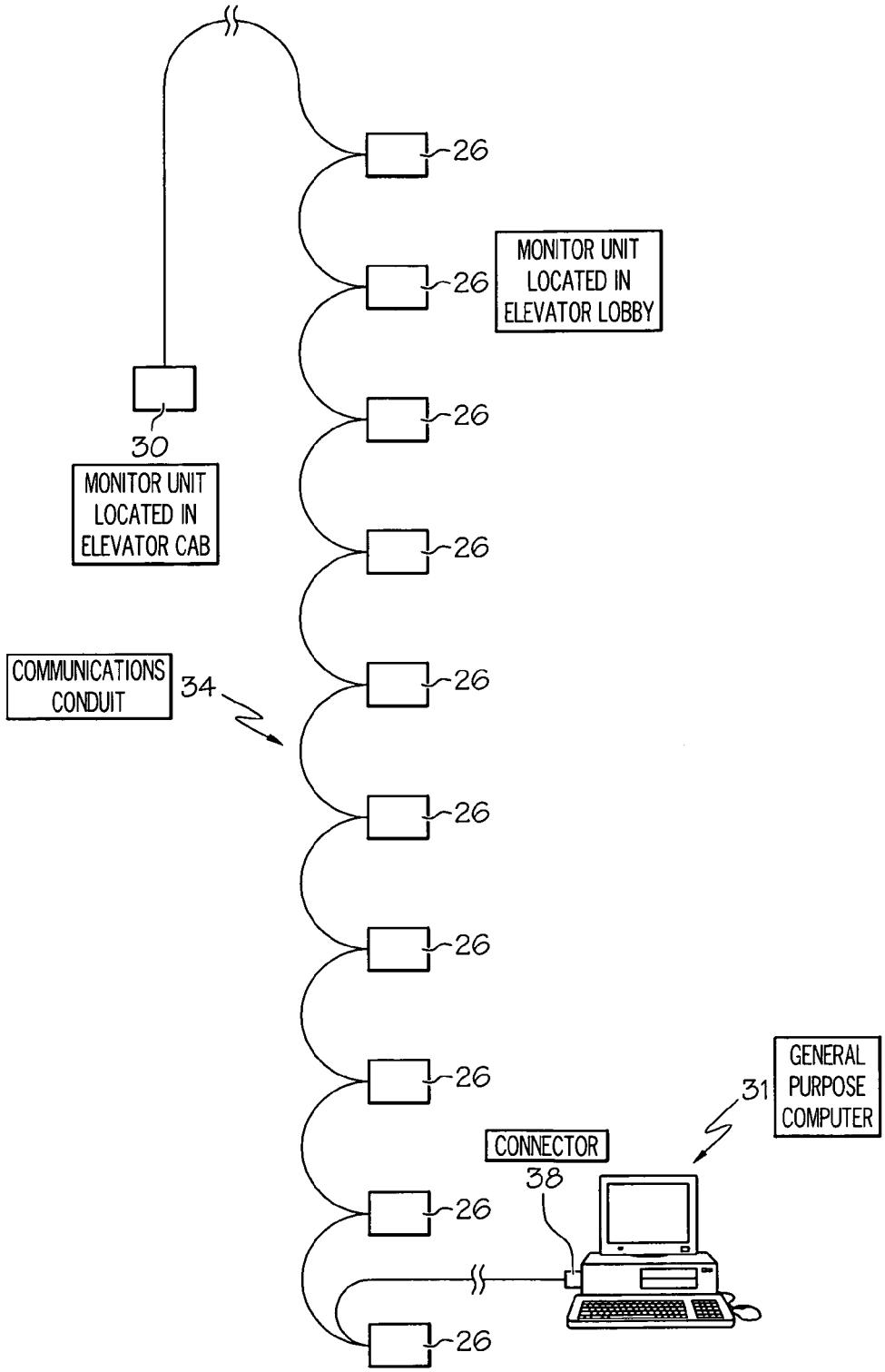
FIG. 2 is a schematic view depicting the display system of FIG. 1, including aspects not shown in FIG. 1 such as a communication conduit and a general purpose computer.

Referring now to FIGS. 1 and 2, elevator system 11 includes a display system comprising one or more individual monitor units 26 located in one or more of the elevator lobbies 14, and/or one or more individual monitor units 30 located in one or more of the elevator cabs 10. For example, one display system includes monitor units within multiple elevator lobbies associated with one or more elevator cabs, but does not include any monitor units within the elevator cabs. Alternatively, a display system can include monitor units within multiple elevator cabs, but might not include any monitor units within elevator lobbies. As still another example, as shown for example in FIG. 1, a display system includes monitor units within one or more elevator cabs 10 and within one or more elevator lobbies 14. A display system in accordance with the present invention can include as few as two monitor units, and can include as many monitor units as are desired.

Figure 3:
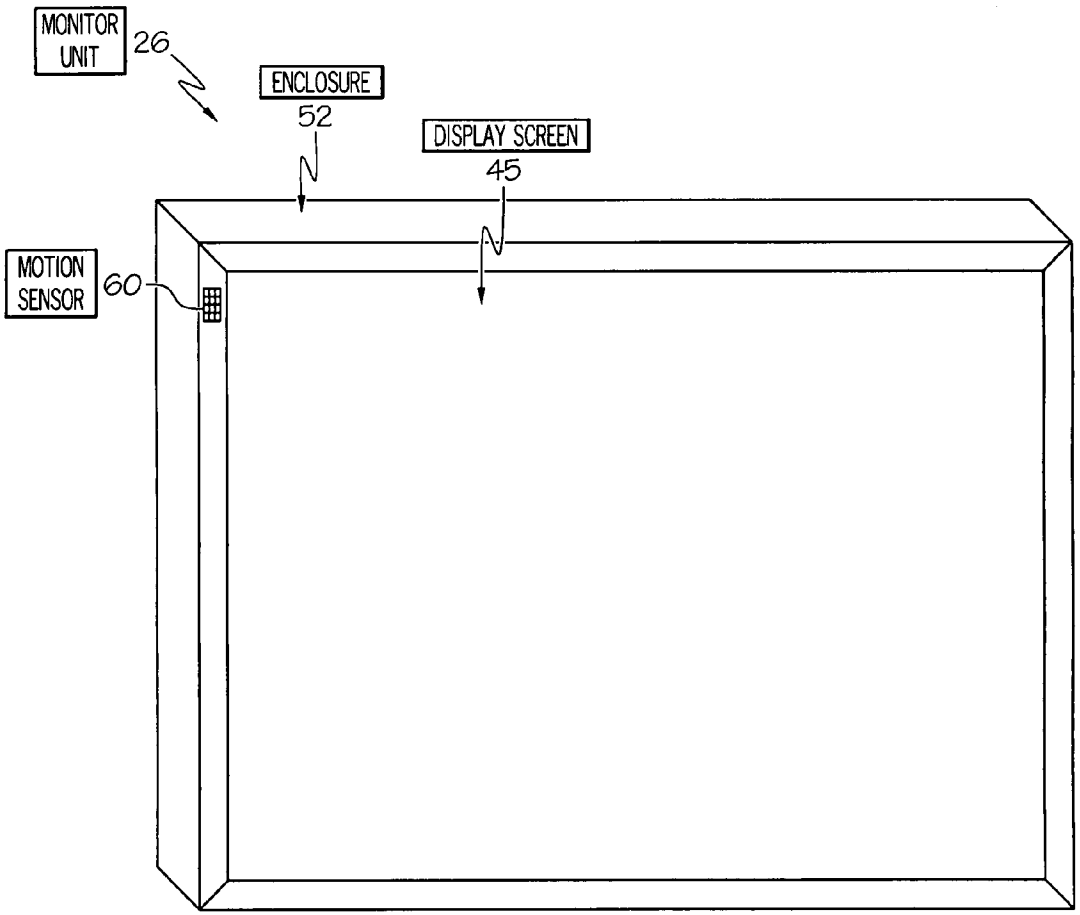
FIG. 3 is a perspective view depicting the external frontal appearance of the monitor units of FIGS. 1-2.

The external configuration of the monitor unit 26 is depicted in FIG. 3. The monitor unit 26 is shown to include an enclosure 52 that partially surrounds and protects the edges of a display screen 45. The display screen 45 can be of any of a variety of display types, particularly a flat panel display device (e.g., LCD, TFT). The enclosure 52 is also shown to include an optional motion sensor 60, to be discussed hereinafter in further detail. It will be appreciated that the external configuration of the monitor unit 26 (e.g., enclosure 52) can assume any of a variety of specific shapes and orientations. However, in one embodiment of the present invention, the enclosure 52 is configured such that it can be mounted directly upon a wall (e.g., the wall of an elevator cab or elevator lobby) without recessing into the wall, and protruding from the wall by less than about 1.0 inch (2.5 cm), or even about 0.5 inch (1.3 cm). By not requiring any recess into the wall, installation time for the monitor unit 26 can be greatly reduced. Also, by having a thin profile from the wall, the monitor unit 26 (e.g., enclosure 52) is less likely to sustain damage from passengers (e.g., 20), and passengers are less likely to be injured through inadvertent contact with the monitor unit 26. For these reasons, the thinnest possible profile is desired.

In order to achieve the thinnest possible profile and overall smallest possible enclosure size, it will be appreciated that the components of the monitor unit are carefully selected to balance flexibility and functionality with size reduction. To achieve this result, the monitor unit 26 does not include a general purpose computer. A general purpose computer (e.g., a DOS- or Windows-based personal computer) is not desirable for implementation as a monitor unit in the present invention due to its relatively large physical size and its complexity as compared to that required of the monitor units described herein. Also, a general purpose computer, due to its complicated software and hardware architecture, can be considerably less reliable than a monitor unit described herein. Furthermore, because the monitor units described herein generally include less components than a general purpose computer, the price of a monitor unit can be significantly less than a general purpose computer. Also, because the monitor units involve fewer components than a general purpose computer, their power consumption is also generally lower. By not including a general purpose computer, a monitor unit in accordance with the teachings of the present invention might not be configured to interface with communications protocols which are typically native to general purpose computers such as, for example, Ethernet and TCP/IP. Further, it is contemplated that the monitor units generally do not comprise any viewer or passenger-accessible controls, such as pushbuttons or switches or, more particularly, a keyboard or mouse.

Figure 4:
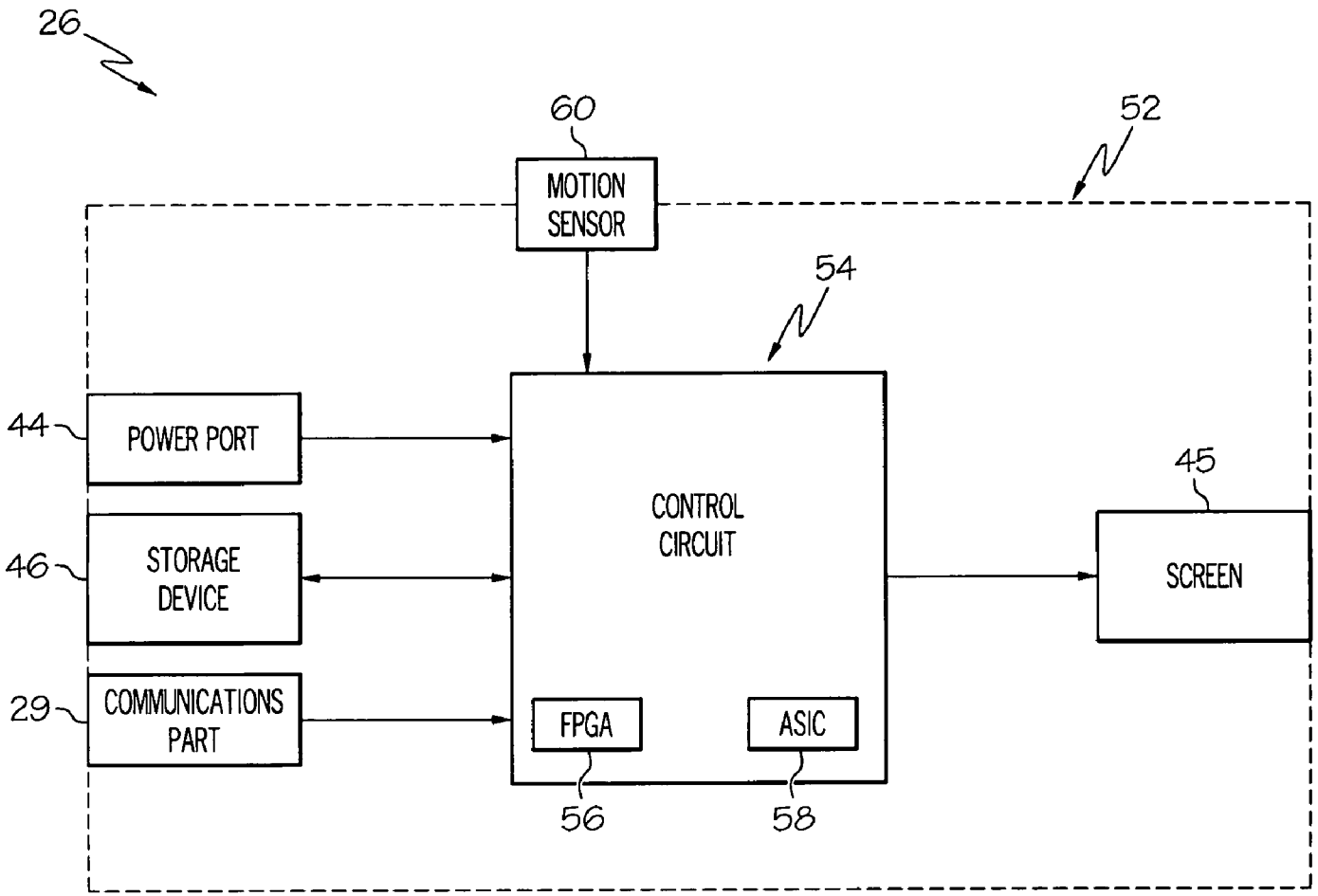
FIG. 4 is a structural block diagram generally depicting the electronic configuration of the monitor units of FIGS. 1-3.

FIG. 4 depicts in block form one illustrative electronic configuration of a monitor unit 26. This same configuration may be used for a monitor unit 30 within a cab 10. The screen 45 receives signals from a control circuit 54. The control circuit 54 can include any of a variety of components, including, for example, a field programmable gate array (FPGA) 56, an application specific integrated circuit (ASIC) 58, a processor, and/or any of a variety of other components. Control circuit 54 receives power from a power input port 44. It should be appreciated that a power conditioning circuit might also be provided as part of power port 44, control circuit 54, and/or between power port 44 and control circuit 54. Such a power conditioning circuit can ensure that an appropriate power signal is transmitted to the control circuit 54.

Control circuit 54 is also connected with a storage device 46. The storage device 46 can be configured to store image information (e.g., containing images for display upon the display screen 45). The storage device 46 might also be configured to store control information (e.g., for instructing the control circuit 54 as to which of the stored data images to display on the display screen 45 at any particular time). In one embodiment, the storage device 46 may comprise a receptacle along with a removable memory card. It will be appreciated that this removable memory card can assume any of a variety of formats, such as, for example, Smart Media, Memory Stick, Multimedia Card, Secure Digital, Compact Flash, and/or many others. Advantages of removable memory cards include ease of memory enhancement, ease of replacement of faulty memory, ease of data content replacement, and many others. Although both the image information and the control information may be stored on a removable memory card, in some embodiments, only the image information is stored on the removable memory card while the control information is stored in a separate (and possibly non-removable) storage device (e.g., BIOS memory) that is associated with the control circuit. Image information can be formatted and/or stored upon a removable memory card in a manner different than that which is familiar to a digital camera (i.e., so that a monitor unit could not extract image information from a memory card taken directly from a digital camera).

In other embodiments, no portion of the storage device 46 is removable (e.g., the entire storage device might be soldered in place). Advantages of non-removable memory include reduced cost, increased speed, increased reliability, and others. Although volatile memory may be employed, it will be appreciated that non-volatile memory will desirably be used in order that the image information is not lost if power to the power port 44 is interrupted.

A communications port 29 may also be provided, and may be connected with the control circuit 54. As will be described in further detail below, communications port 29 can be adapted to receive image information and/or control information from a remote source such as a general purpose computer. Any of a variety of data formats might be employed, as discussed in further detail below.

As shown in FIGS. 3-4, the enclosure 52 can directly or indirectly support (e.g., by connecting with or otherwise surrounding or housing) each of the display screen 45, the communication port 29, the power port 44, the storage device 46, and the motion sensor 60. Although not particularly depicted in FIGS. 1-4, it should be appreciated that the power port 44 and the communications port 29 can be disposed upon a location of the enclosure 52 that is suitable to interface with connecting wires (e.g., from behind the enclosure 52, or through conduit attaching to one of the edges of the enclosure 52).

It will be appreciated that a display system in accordance with the teachings of the present invention can include monitor units that are connected sequentially by a communications conduit 34, as shown for example in FIG. 2. This communications conduit 34 can include any of a variety of specific wire conductor combinations and/or arrangements, and/or can communicate using any of a variety of available communications protocols. In certain embodiments of the present invention, a communications conduit might employ a serial communications protocol which cannot, without provision of additional interface hardware, interface with a general purpose computer. For example, the communication conduit might employ a protocol other than one selected from the group consisting of Ethernet and TCP/IP, such as, for example, any of an RS-485 protocol, an RS-422 protocol, an RS-232 protocol, a CANBUS protocol, a PROFIBUS protocol, an INTERBUS protocol, a FOUNDATION FIELDBUS protocol, and a DEVICENET protocol.

It will be appreciated that a sequential connection among individual monitor units (e.g., as shown in FIG. 2) avoids the need for individual wires leading from each of the monitor units to a central location (e.g., a hub). Hence, a single cable can provide a communications conduit to multiple monitor units in order to provide such a sequential connection. Again, the exact connection details will depend in large part upon the communications protocol that is selected, and are well known by those skilled in the art.

The monitor units of the present invention are configured to receive image information and control information over the communications conduit, and then to resultantly display the image information in accordance with instructions provided within the control information. The monitor units therefore are not configured to display image information in real time as the image information is received over the communications conduit (e.g., they are not configured like television sets receiving cable television signals). Furthermore, different image information and control information can be provided to respective monitor units within a display system in accordance with the teachings of the present invention. To provide such functionality, each monitor unit can be individually addressable upon the communications conduit. In one particular example, a two-wire RS-485 connection can be provided to connect multiple monitor units within a display system (e.g., as in FIG. 2).

A connector 38 might also be provided at some point along the communications conduit 34. The connector 38 can be configured to selectively interface a general purpose computer 31, as shown for example in FIG. 2. This general purpose computer 31 can be used to download new image information and/or control information to any of the monitor units at any time (i.e., through individually addressing the new information to the particular monitor unit over the communications conduit). After suitable information has been downloaded to the monitor units, it should be appreciated that the general purpose computer 31 can be disconnected from the connector 38, can be taken from the premises, and/or can be powered down. After this information has been downloaded to the individual monitor units, it should therefore be appreciated that the general purpose computer 31 has no ongoing role in the operation of the monitor units. Rather, the general purpose computer 31 serves only as a download tool, not as a server.

One advantage of this system is that there is no need for a general purpose computer dedicated to the task of overseeing the monitor units. Rather, a laptop (a variety of general purpose computer) or other portable device may be connected to download new information to the monitor units only periodically (e.g., daily, weekly or monthly). As another advantage, because the information is not displayed on the monitor units in real time as it is transferred to the monitor unit, the data transfer speed need not be very high, and slower data transfer protocols (e.g., such as RS-485) can be effectively employed. These slower data transfer protocols are often simpler and less expensive to install and maintain than higher speed protocols that would be necessary to provide real time display of images as they are downloaded from a general purpose computer. Also, information need not ever be transmitted back from a monitor unit to the general purpose computer (although such reverse transmission may occur to enable the general purpose computer to verify that a monitor unit has received certain data).

To install a display system in accordance with the present invention, monitor units can be hung upon walls of elevator cabs and/or elevator lobbies of an elevator system. Power can be provided to each of the monitor units from any of a variety of power supplies that may be local to the individual monitor units. The communications conduit can be connected as discussed above. A general purpose computer may then be temporarily connected with the communications conduit. Through use of the general purpose computer, control information and image information can then be individually sent to each of the monitor units over the communications conduit. The image information can comprise images such as JPEG, TIFF, BMP, GIF, PNG or any of a variety of other data types. The control information can instruct the monitor units as to how to display the image information. For example, the control information can constitute a series of scripts, each of which can indicate an image to display and a length of time for display of that image. As the control circuit processes the control information, each of these scripts is acted upon in succession, thereby causing the desired sequence of images to be displayed on the display screen. The control information might also include additional information as well, such as specific aspects regarding the manner in which images shall be removed and/or placed upon the display (e.g., fade in/out).

In one specific example, a general purpose computer may be used to download image information to a monitor unit that includes eighty JPG images, as well as control information containing eighty script commands. Each image may be a separate advertisement, and the script commands may be written such that each image appears on the display screen for ten seconds, thereby enabling passengers sufficient time to view and absorb all of the information within each image. After all of the images have been displayed, the script commands repeat until new control information is downloaded from the general purpose computer. In an alternate example, the image information might include ninety images, but the scripts might cycle images fifteen times per second (or more frequently), thereby resulting in the appearance of a six second video on the display screen. It should be appreciated that virtually any combination of still images and video (i.e.: quickly sequenced still images) can be displayed upon a given monitor unit. A monitor unit might also be provided with a speaker in order that audio can be provided in connection with the images or in lieu of the images.

The progression of scripts may also be related to a motion sensor optionally provided within (or in close proximity to) a monitor unit. The motion sensor, generally electrically connected with the control circuit of a monitor unit and supported by the enclosure thereof, may be configured to generate activation signals such that the control circuit is operative to selectively display image information on the display screen of the monitor unit at least partially in response to the activation signals generated by the motion sensor. For example, if a motion sensor detects passengers, the script may be started such that images are displayed. In another embodiment, the motion sensor might merely control whether the backlight for the display screen is activated. Providing a motion sensor can thereby disable at least some components of a monitor unit when passengers are not present, thus conserving energy and extending the useful life of the monitor unit.

While images cannot be downloaded to and displayed by the monitor units in real time, control information (e.g., scripts) can be downloaded to a monitor unit in real time (i.e., nearly instantaneous, as compared to the time necessary for an elevator to move between floors). Control information, once received by a monitor unit, can cause an already stored image within the storage device of a monitor unit to be displayed in real time. Accordingly, the images presented on a monitor unit can be controlled in real time, provided that the images themselves had been previously stored in the local memory (e.g., the storage device) of the monitor unit. For example, if a building has ten floors (e.g., as in FIG. 1), ten images might be stored within the storage device of a monitor unit, wherein each of the ten images presents one of the numbers from one to ten. An elevator controller may then be coupled with the communications conduit that connects each of the monitor units, and can be configured to generate a new script indicative of floor location as an elevator cab moves among floors. A monitor unit can receive these scripts in real time and can resultantly call for the display of the appropriate floor location image for display upon the screen in real time when the elevator cab is approximately aligned with that floor. Other command information that may be passed to the monitor units might include building fire alarm status information, for example. Furthermore, it should be appreciated that a display screen of a monitor unit might display more than one image at any given time. For example, part of the display screen might be used to display an advertisement while another part of the display screen can be simultaneously used to display an image corresponding to building floor location.

Using the display systems and methods provided herein, it will be appreciated that passengers within an elevator cab and/or an elevator lobby can be presented with advertisements during their time waiting on or for an elevator cab. While the passengers may enjoy having these advertisements to occupy their waiting time, the building managers may profit by selling this advertising time to vendors. In the elevator system context, it should also be appreciated that the display system might be configured to display, either in addition to or in lieu of advertisements, information concerning weather, geographic aspects, elevator cab location information, product information, service information, and building occupant directory information, or any other information of interest to passengers.

The display systems and methods described herein may also be used in locations not involving elevator systems. For example, such a display system might be installed within a retail store, wherein individual monitor units are positioned at various locations around the store, such as near respective products being sold. Such monitor units could then provide dynamic information regarding those products. As another example, such a display system might be installed within a museum or other public exhibit, wherein individual monitor units can be placed near particular items or groupings of items within the exhibit. Information regarding those items or groupings can then be dynamically displayed upon the monitor units.

The monitor unit is a video image display device which can be based upon the "System on Chip" system. This principle can be applied in the monitor unit by the use of a Field Programmable Gate Array ("FPGA"). The FPGA might be the only programmable decision-making component within the monitor unit, and firmware within the FPGA can control the operation and the function of the entire monitor unit. Even though a monitor unit can be built using state of the art technology, the price of a monitor unit can be much lower than that of a general purpose computer. For example, a cost efficient monitor unit can include main memory comprising high capacity Synchronous Dynamic Random Access Memory ("SDRAM") and buffer memory comprising small size static memory. The power consumption of a monitor unit (e.g., 8.4 W) can also be much lower than that of a general purpose computer (e.g., 100 W), thus resulting in a significantly reduced operating cost for the monitor unit. Maintenance costs of a monitor unit are also minimal as compared to a general purpose computer due to superior reliability of the monitor unit, reduced need for periodic service, and ability for remote software reconfiguration. A monitor unit can also be smaller than a general purpose computer as its size can be substantially limited to the physical size of its display screen. Monitor units can be placed in extremely varied locations such as entrances, hallways, elevators, and multi-screen applications (wherein several monitor units are assembled to obtain a larger screen).

A monitor unit in accordance with the present invention can include several components arranged in any of a variety of suitable configurations. For example, the components can be selected so that the monitor unit can operate within a desired temperature range (e.g., 5-45 degrees Celsius). Also, to optimize reliability, the monitor unit can be designed to have the smallest possible number of components and moving parts. The monitor unit can be provided with a 12 V.D.C. power supply, and components within the monitor unit can convert this supply voltage to other voltages as needed.

The monitor unit can include a display screen, such as an LCD display screen. An LCD display screen can provide a good quality image, high resolution and a small mounting size. LCD display screens generate less heat than other conventional screens, and associated electronic components can accordingly be closely disposed. As a result, monitor units incorporating an LCD display screen can be provided in small packages suitable for use in small spaces (e.g., in an elevator). A display screen can have six or eight color bits per pixel, although the difference in picture quality is not significant between these options, and a lower frequency can be used and less cost is involved when only six bits per color are used. Low Voltage Differential Signaling ("LVDS") can be used as the communication standard between the display and the circuit board so that the video data can be sent through of a relatively small number of wires. The display screen can be provided with a digital interface so that the need for an analog/digital conversion is eliminated. Practically, of all components of the monitor unit, the display screen has the lowest Mean Time Between Failure ("MTBF"). Nevertheless, the MTBF standing of the monitor unit is high as compared to systems that involve a general purpose computer. The monitor unit can also include an inverter for powering a backlight for the display screen. The inverter provides a high voltage constant current power generator for the backlight of the display screen, and the use of a display screen refresh frequency ranging around the inverter frequency should be avoided.

A monitor unit can be connected directly to a general purpose computer through a Universal Serial Bus ("USB") or can be connected to an RS485 bus. In particular, the monitor unit can include a USB connector and can operate as a slave on a USB bus. An interface chip facilitates conversion between the USB and Low Voltage Transistor to Transistor Logic ("LVTTL") signals. Communication between the interface chip and the FPGA is done by Universal Asynchronous Receive Transmit ("UART"). The communication rate ranges between 9600 bps and 3 Mbps and is set by software within the USB-Master device (e.g., a general purpose computer). The USB chip can be line-powered so that there is no need for a separate power source. An Electrically Erasable Read Only Memory ("EEprom") and/or a crystal can also be provided.

The monitor unit can include a connector for interfacing an RS485 bus and can be placed upon the RS485 bus as a passive device. Passive operation means that the monitor unit cannot send packages on the bus of its own will. The available baud rate depends upon such factors as the length and type of the RS485 cable and the type of line transceiver used. The longer the cable, the lower the maximum baud rate that can be used. The RS485 interface used can be the dominant or standard RS485 mode. A server (e.g., a general purpose computer) may send various types of data packages and commands packages over the RS485 bus to the monitor unit. The monitor unit can receive these packages from the bus according to a certain protocol, and can issue messages confirming receipt of certain packages. Data packages can transfer a file from the monitor unit to the server according to a TCP/IP transfer mechanism.

The monitor unit can additionally include a circuit board which can provide, support or otherwise interface some or all of the other components of the monitor unit. The circuit board can be capable of high frequency (e.g., 7MHz-80MHz) operation. Components can be mounted on one or both sides of the circuit board, and the circuit board may have one or more layers. For example, the circuit board can include components for interfacing the display screen such as a LVDS transceiver and related connectors. Cables can be provided within the monitor unit to connect together the various components of the monitor unit.

A monitor unit can also include many software elements such as, for example, an SDRAM controller, a Joint Photographic Expert Group ("JPEG") decoder, a UART, a Compact Flash ("CF") interface, a Static Random Access Memory ("SRAM") interface, a display screen controller, a processor, a Serial Peripheral Interface ("SPI"), and/or an Integrated Drive Electronics ("IDE") interface. A Timer interface can also be provided to facilitate accurate measurement of time periods, and a Pixel interface can be provided to modify data in the SDRAM memory.

SDRAM memory (e.g., 128Mb) can be used to store decompressed images for display. Several (e.g., four) equally sized areas can be provided within the SDRAM which are each of sufficient size to hold a respective image. While an image is built in one of these areas, an already decompressed image in another area can be displayed on the display screen. Due to the high operation frequency, terminator resistors can be provided to prevent reflections from appearing due to the similar dimension of the wavelength and the course length. An SDRAM controller can be provided to interface the SDRAM with other components of the monitor unit. A display screen refresh can occur at the same time as a new image is being written in one of the areas. For example, twenty frames per second may be obtainable for a given resolution. An initialization macro command can prepare the SDRAM for subsequent operations and initializes the operating parameters for the SDRAM. A First In First Out ("FIFO") data queue can store the data that are transferred between the SDRAM and the video controller and between the SDRAM and the JPEG block. After the initialization sequence, the display screen controller can command data reading and indicate refresh intervals. The SDRAM controller writes data for the video controller in FIFO at a constant speed with small breaks due to the additional line-closing/opening operations, and the video block reads the data at the same constant speed, but without breaks. The video block performs the LCD refresh and commands SDRAM refresh.

A monitor unit can include a CF card and/or Dataflash. A CF card can serve as the main non-volatile memory and can store serially received or pre-recorded files containing images and various operation and configuration information. Such files can be processed for display or they can be sent to other monitor units. A connector for receiving a CF card can be placed on the circuit board. Although a hard drive can be provided instead of a CF card to store data, the MTBF is low for a hard drive as compared to that of the CF card. A CF card has several access modes, namely I/O mode, memory mode, and true IDE mode. An IDE interface in the monitor unit enables the processor to communicate by implementing read and write access functions. Dataflash memory (e.g., 128 Mb) stores the processor program. An SPI interface can be used to communicating with Dataflash. Half of the memory contains the processor code, whereas the other half contains a start image.

Depending upon the hardware selected, there are several software configurations that can be provided within a monitor unit. The simplest hardware solution does not contain CF or serial Dataflash. The processor can decode communications (e.g., via USB or RS485) and JPEG file markers. No start image can be displayed, but rather a black screen can be displayed until the first picture is received. The serial data received can be stored in SRAM, and then the JPEG decoding can be done. SRAM memory can store remote data and the processor program data. Half of the memory can serve as a buffer for JPEG images received serially, whereas the other half can be used by the processor as data and code memory. The UART block receives the serial data and the processor interprets them. The JPEG decoder receives data from the processor, decodes the image and stores the decoded image in SDRAM. The decompressed image can then be stored in SDRAM and displayed on the display screen. The FPGA can perform these operations. The video controller provides the display screen with the necessary data and timing. The screen can display a welcome string, and can then display a digital clock and an analog clock. The monitor unit can wait for JPEG files to be received in full before displaying them.

In an alternate configuration, a monitor unit contains a CF card or Dataflash. There are two software solutions. The first solution does not require CF card, rather the processor boots from serial DataFlash and displays a start image stored in DataFlash. The monitor unit may receive JPEG files and can display them. The second solution does not require DataFlash. Rather, the processor boots from CF, then executes a script, according to which it can receive serial files, transmit serial files, read or write files in CF and display on the screen any JPEG file received serially or stored on CF. Accordingly, the monitor unit can receive static image compressed files in a JPEG format from the CF card and displays them on the display screen. Alternatively, pictures displayed on the screen can be received from an RS485 communication bus, from a server, or from another monitor unit.

The JPEG decoder operates by first decoding the structure of the received data. The processor is in charge of this step, and can program the currently displayed buffer and the decoding buffer. To decode an image, a decoding buffer can be selected and then a file must be transferred to the decoder. The processor identifies markers in the JPEG baseline such as SOS (start of scan), SOF (start of file), DHT (decoder huffman table), DQT (decoder quantization table), and EOF (end of file). Upon receipt of a header, the processor sends the data in each marker body to the decoder. The processor does not allow for the decoding of a file with an incomplete or wrong format header. While receiving data, the header block decodes the data and generates necessary tables based on the information received. After reception is over, the data is read from RAM to generate the uncompressed picture. The picture can be processed block by block by Huffman decoding, dequantization and zigzag ordering, and then by Inverse Discrete Cosine Transformation ("IDCT").

The monitor unit can include a processor (e.g., a RISC processor) which functions to support various communications protocols, read/write data, process images, facilitate display of text, and facilitate automatic testing and diagnostics. The processor can be selected to have a small physical size. Upon turning on the monitor unit, the processor performs the functional testing of the main components (integrity, memory, stored data, CRC, etc.) and can also facilitate display of a logo image. The processor can transmit and receive data through use of a UART Interface. The processor executes code from the boot zone (internal ram in the FPGA) and from external static memory. The boot code performs minimal functioning tests, and then copies the code and initialized variables from the Dataflash or CF memory into the external memory. The boot zone may be extended depending on the ram available in FPGA. If the program does not need a code larger than the boot zone, the external ram is not necessary. The main code can be run from the external static memory. To avoid collisions between data, a memory map can be defined.

When the monitor unit is assembled and powered, the firmware starts execution. In the first stage, characters are transmitted through the RS485 or USB to confirm operation of the monitor unit. Existence of the serial flash is then verified and if missing, the processor stops. Then, testing of the external ram is started. In case of an error, the address where the error was found is read. If the test is successfully passed, the minimal functions are deemed operational and the boot mode confirmation is expected. If no character is serially received for two minutes, the processor tries to boot from the Dataflash. If the Dataflash is corrupted or was not programmed, the processor continues to wait for the confirmation of a boot mode. Otherwise, the processor copies the Dataflash code into SRAM and executes it. After the program is received, the processor calls a program writing sub-routine in flash that can be found in the received object code. After the writing, the received object code is executed. After the serial flash code is copied into SRAM, it starts to execute the main code. At this time, the CF presence is keyed in. The processor reads the CF identification data and if the CF is present, it displays them. If a CF card is not detected, the processor stops.

The main program can perform several functions, namely a terminal mode, a script mode, and an RS485 mode. In every mode, the operation is completely different. In the terminal mode, the commands are manually introduced and are executed after they are introduced. In the script mode, the commands are similar to the terminal mode, but they are stored in memory and successively executed, without any pause between them. The RS485 mode operates differently.

Generally, the program commands execution of the script. A script represents a series of strings defined in memory. The commands in script are interpreted by the monitor unit. A "stor" command can be used to select and write into memory one of the images from a CF card. The "play" command distributes one of the CF files to another device on an RS485 bus. The "decf" command orders the decoding of a JPEG file. The "decb" and "view" display an image stored in one of the four JPEG buffers. The "simp" command orders execution of the script from the desired position and may be executed both the terminal and script modes. In the script mode, this function may be used to obtain an infinite script. The "m485" command orders the shift of the monitor unit into the RS485 mode. The "pstr" command performs a series of graphic functions. The "bcst" command cannot be interrupted. The "stmv" command stores in CF a sequence of multiple JPEG files and can only be used in terminal mode. The "plmv" command displays the stored image sequence. The script is completed when a "kill" command is detected.

Command packages include a "show file", a "new program", and a "store file". The "show file" command package determines which file is displayed on the display screen. If the file was not received, the command will not do anything. The "new program" command package replaces a program stored in Dataflash with a new program previously sent on the serial link. The "store file" command package replaces or adds a file in CF. If the file was not sent or if it suffered an error, the command has no effect. The command has as a parameter the number of the location where the file has to be saved. Multiple data protection mechanisms may also be provided. For example, sequential number data protection can be used to protect against package losses, start/stop package data protection can also be used to ensure that an entire file is sent, and CRC16 CCITT can be used to detect common errors (e.g., bit errors, odd burst errors).

A monitor unit interprets the package if the address on the package corresponds to its address, or if the address on the package is a broadcast address. The packages that have a different address are ignored. If a package is lost while transferring a file, the entire file can be resent. The commands receive a response package that confirms or rejects the execution. The monitor unit can then send a package indicating error or success.

The foregoing description of embodiments and examples of the invention has been presented for purposes of illustration and description. It is not intended to be exhaustive or to limit the invention to the forms described. Numerous modifications are possible in light of the above teachings. Some of those modifications have been discussed and others will be understood by those skilled in the art. The embodiments were chosen and described in order to best illustrate the principles of the invention and various embodiments as are suited to the particular use contemplated. The scope of the invention is, of course, not limited to the examples or embodiments set forth herein, but can be employed in any number of applications and equivalent devices by those of ordinary skill in the art. Rather it is hereby intended the scope of the invention be defined by the claims appended hereto.

What is claimed is:

1. An elevator system for movement of passengers among respective floors of a building, the elevator system comprising:

at least one elevator cab being moveably supported within an elongated vertical passageway, the passageway extending adjacent to a plurality of lobbies, each lobby being located upon a distinct floor of a building, the elevator cab being configured to receive passengers from at least some of the plurality of lobbies;

a control system being connected with said elevator cab and being configured to selectively move said elevator cab through said passageway;

a display system comprising a plurality of monitor units being disposed in locations visible to elevator passengers, each monitor unit comprising an enclosure, a display screen, a communication port, a power port, a storage device, and a control circuit, the control circuit being electrically connected with each of the display screen, the communication port, the power port, and the storage device, the enclosure supporting each of the display screen, the communication port, the power port, the storage device, and the control circuit, wherein the control circuit does not comprise a general purpose computer and is unable to operate an off-the-shelf operating system;

a communications conduit being sequentially connected to the communication port of each of the monitor units, the communications conduit being configured to be selectively connected with a general purpose computer, wherein each of the monitor units is individually addressable over the communications conduit by a general purpose computer for receiving individualized control information and image information from a general purpose computer;

wherein the control circuit of each of the monitor units is configured to store the control information and the image information within the storage device, and is further configured to act in accordance with the stored control information to selectively provide at least some of the stored image information to the display screen.

2. The elevator system of claim 1 wherein at least some of the locations are within elevator lobbies.

3. The elevator system of claim 1 wherein at least some of the locations are within elevator cabs.

4. The elevator system of claim 1 wherein at least some of the locations are within elevator lobbies and wherein at least some of the locations are within elevator cabs.

5. The elevator system of claim 1 wherein the communication conduit does not employ a protocol selected from the group consisting of Ethernet and TCP/IP.

6. The elevator system of claim 1 wherein said enclosure is configured to be wall-mounted such that no portion of said monitor unit recesses into a wall, and such that no portion of said monitor unit protrudes from a wall by more than about 1.0 inches (2.5 centimeters).

7. The elevator system of claim 1 wherein said monitor units do not comprise a passenger-accessible control.

8. The elevator system of claim 1 further comprising a motion sensor being electrically connected with the control circuit of at least one of the monitor units, the motion sensor being supported by the enclosure of the at least one of the monitor units and being configured to generate activation signals, the control circuit being operative to selectively display the image information on the display screen at least partially in response to the activation signals.

9. The elevator system of claim 1 wherein the storage device comprises non-volatile memory.

10. The elevator system of claim 1 wherein the monitor units are configured to display advertisements.

11. The elevator system of claim 1 wherein the monitor units are configured to display information selected from the group consisting of weather information, geographic information, elevator cab location information, product information, and service information.

12. The elevator system of claim 1 wherein the control circuit consists essentially of at least one of a field programmable gate away and an application specific integrated circuit.

13. The elevator system of claim 1 wherein a general purpose computer need not be continually connected with the communications conduit during operation of the monitors.

14. The elevator system of claim 1 wherein said control circuit is not configured to display the image information on the display screen in real time as the image information is received from a general purpose computer via the communications conduit.

* * * * *